US006772721B1

(12) United States Patent
Gardner et al.

(10) Patent No.: US 6,772,721 B1
(45) Date of Patent: Aug. 10, 2004

(54) TORSIONAL ASSIST CAM PHASER FOR CAM IN BLOCK ENGINES

(75) Inventors: Marty Gardner, Dryden, NY (US); Mike Marsh, Dryden, NY (US); Mark Wigsten, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/459,666

(22) Filed: Jun. 11, 2003

(51) Int. Cl.[7] ..... F01L 1/34

(52) U.S. Cl. ..... 123/90.17; 123/90.18; 74/568 R

(58) Field of Search ..... 123/90.12, 90.15, 123/90.16, 90.17, 90.18, 90.31; 74/568 R; 464/1, 2, 160

(56) References Cited

U.S. PATENT DOCUMENTS

| | | | | | |
|---|---|---|---|---|---|
| 5,002,023 | A | | 3/1991 | Butterfield et al. | 123/90.15 |
| 5,107,805 | A | | 4/1992 | Butterfield et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,657,725 | A | | 8/1997 | Butterfield et al. | 123/90.17 |
| 5,666,914 | A | | 9/1997 | Ushidae et al. | 123/90.17 |
| 6,035,819 | A | * | 3/2000 | Nakayoshi et al. | 123/90.17 |
| 6,250,265 | B1 | | 6/2001 | Simpson | 123/90.17 |
| 6,263,843 | B1 | * | 7/2001 | Todo et al. | 123/90.17 |
| 6,263,846 | B1 | | 7/2001 | Simpson et al. | 123/90.17 |
| 6,311,655 | B1 | | 11/2001 | Simpson et al. | 123/90.17 |
| 6,338,323 | B1 | * | 1/2002 | Machida | 123/90.17 |
| 6,374,787 | B2 | | 4/2002 | Simpson et al. | 123/90.17 |
| 6,247,434 | B1 | | 6/2002 | Simpson et al. | 123/90.17 |
| 6,439,184 | B1 | * | 8/2002 | Takenaka et al. | 123/90.17 |
| 6,477,999 | B1 | | 11/2002 | Markley | 123/90.17 |
| 2002/0050257 | A1 | * | 5/2002 | Watanabe | 123/90.17 |

FOREIGN PATENT DOCUMENTS

| | | | |
|---|---|---|---|
| JP | 08121123 A | 5/1996 | F01L/1/34 |

* cited by examiner

*Primary Examiner*—Thomas Denion
*Assistant Examiner*—Jaime Corrigan
(74) *Attorney, Agent, or Firm*—Brown & Michaels PC; Greg Dziegielewski

(57) ABSTRACT

A phaser for maintaining an angular relationship between a crank shaft and a cam shaft or among more than one cam shafts is provided. The phaser includes a rotor having a plurality of vanes integral to the rotor and protruding from the rotor body. The plurality of vanes is disposed to oscillate within their respective chambers formed by the rotor and a housing, thereby maintaining the angular relationship. The phaser also includes a shoulder integral to the rotor and interposed between one of the pluralities of vanes and the rotor body, thereby ensuring that the rotor face is always covering a locking pin hole regardless of vane position. The phaser further includes an inlet check valve located within the phaser structure or in very close proximity to the phaser, thereby reducing control fluid leakage.

11 Claims, 8 Drawing Sheets

TORSIONAL ASSIST CAM PHASER FOR CAM IN BLOCK ENGINES

FIELD OF THE INVENTION

The invention pertains to the field of cam phasers. More particularly, the invention pertains to torsional assist cam phasers for internal combustion engines.

BACKGROUND OF THE INVENTION

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft. The control system utilizes a control valve in which the transfer of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely directed mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes a camshaft with a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposite end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for an internal combustion engine. The system is comprised of a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses, each of which receives one of the lobes and has a circumferential extent greater than the circumferential extent of the lobe received therein to permit oscillation of the housing relative to the vane and the camshaft, while the housing rotates with the camshaft and the vane. Oscillation of the housing relative to the vane and the camshaft is actuated by pressurized engine oil in each of the recesses on opposite sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinally central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing systems. The strategy involves an internal combustion engine that includes a camshaft and hub secured to the camshaft for rotation therewith, where a housing encloses the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft, is described. A housing encloses the rotor, is rotatable with both the rotor and the camshaft, and is further oscillatable with respect to both the rotor and the camshaft between a fully retarded position and a fully advanced position. A locking configuration prevents relative motion between the rotor and the housing, is mounted within either the rotor or the housing, and is respectively and releasably engageable with the other rotor and the housing in either the fully retarded position, the fully advanced position, or positions therebetween. The locking device includes a locking piston having keys terminating one end thereof, and serrations mounted opposite to the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

However, in a phaser having passages for pressurized fluid flowing therein, leakage of fluid is undesirable. Furthermore, a locking pin is required to keep a fixed angular relationship between such things as the crank and cam shaft, in which the locking pin is disposed to be disengaged by fluid pressure. Therefore, it is desirous to have phaser having a structure, whereby fluid leakage is significantly reduced.

SUMMARY OF THE INVENTION

An inlet check valve built within the structure of the phaser or in close proximity to the phaser is provided for reducing control fluid leakage.

A shoulder integral to the rotor and interposed between one of the plurality of vanes and the rotor body is provided.

A centered mounted spool valve disposed along a center line perpendicular to the rotor is provided.

A torsion spring is provided for compensating the cam bearing friction or the oil pump loads which tend to force the phaser in a direction opposite of base timing.

Accordingly, a phaser for maintaining an angular relationship between a crank shaft and a cam shaft or among more than one cam shafts is provided. The phaser includes a rotor having a plurality of vanes integral to the rotor and protruding from the rotor body. The plurality of vanes is disposed to oscillate within their respective chambers formed by the rotor and a housing, thereby maintaining the angular relationship. The phaser also includes a shoulder integral to the rotor and interposed between one of the plurality of vanes and the rotor body, thereby ensuring that the rotor face is always covering a locking pin hole regardless of vane position.

Accordingly, a phaser for maintaining an angular relationship between a crank shaft and a cam shaft or among more than one cam shafts is provided. The phaser includes a rotor having a plurality of vanes integral to the rotor and protruding from the rotor body, the plurality of vanes being disposed to oscillate within their respective chambers formed by the rotor and a housing, thereby maintaining the angular relationship; and an inlet check valve located within the phaser structure or in very close proximity to the phaser, thereby reducing control fluid leakage.

DESCRIPTION OF THE PREFERRED EMBODIMENT

Figure 1:
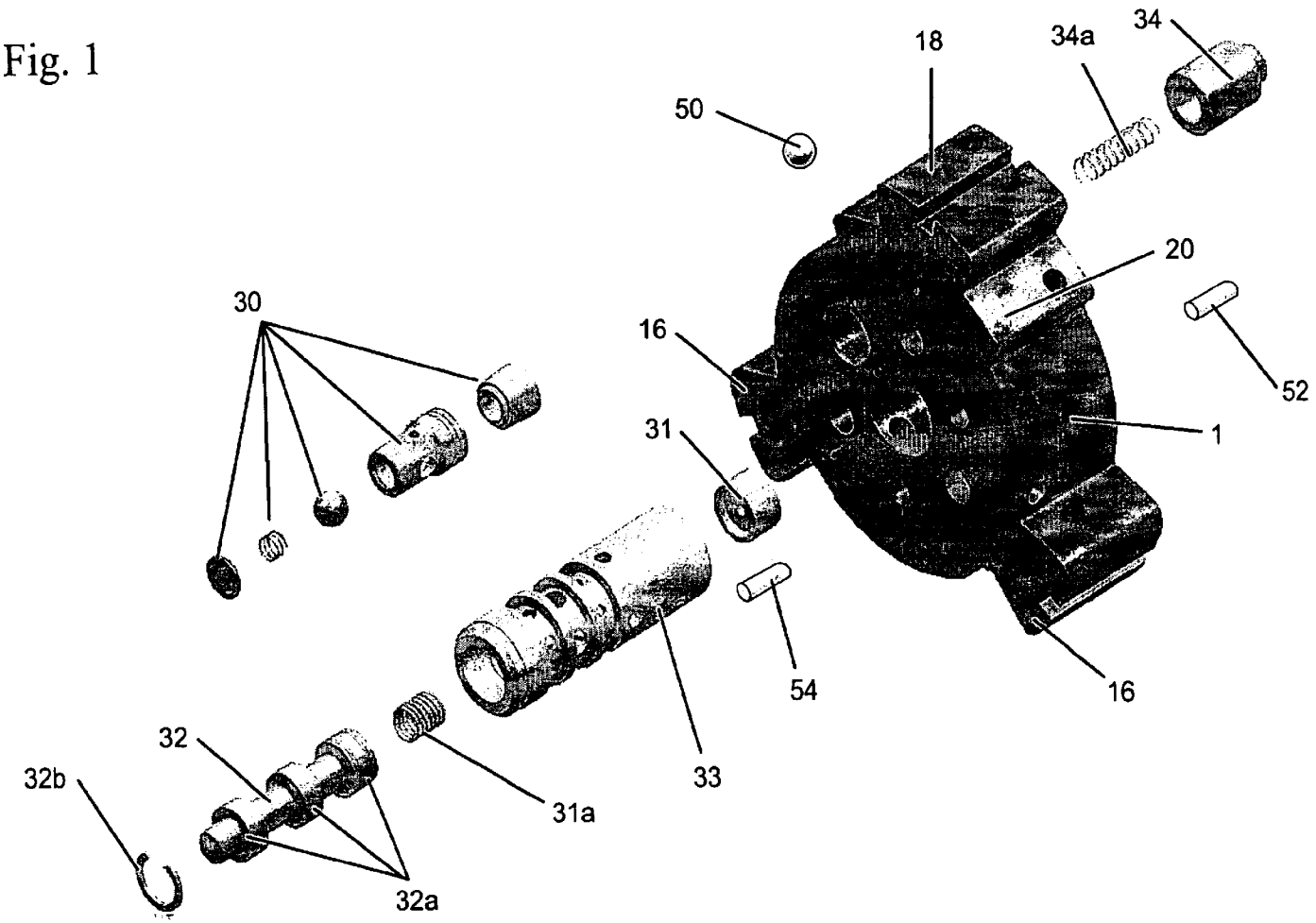
FIG. 1 shows a first exploded view of the present invention.

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the concomitant parts to control the relative angular position of the housing and rotor, which allows the timing of the camshaft to be offset from the crankshaft. In any of the multiple-camshaft engines, it will be understood that there would be one phaser on each camshaft, as is known in the prior art.

Referring to FIGS. 1–8, a rotor 1 is fixedly positioned on the camshaft (not shown), by means of mounting flange (also not shown), to which it (and sometimes a rotor front plate) is fastened by screws (not shown). The rotor 1 has a plurality of radially outwardly projecting vanes. In the present figure rotor 1 has a pair of ordinary vanes 16, and a special type vane 18 having a pair of shoulders 20 interposed between the center circumferential rotor body and the special type vane 18. Each vane 16, 18 fits into its respective recess or chambers (advance and retard) in the housing body (also not shown). The inner plate, housing body, and outer plate may be fastened together around rotor 1 by screws (not shown), so that the recesses holding the vanes 16, 18, enclosed by an outer plate and inner plate, form fluid-tight chambers. The timing gear or sprocket 22 is connected to the inner plate by screws (not shown). Collectively, the inner plate, housing body, outer plate and timing gear will be referred to herein as the "housing".

Referring specifically to FIG. 1, a first exploded view of the present invention is depicted. Rotor 1, disposed to rotate with a housing (not shown), is provided. Rotor 1 has a built-in check valve 30 positioned in close proximity to rotor 1. Rotor 1 has a center portion disposed to rotate in relation to a center axis. The center portion is of a substantially cylindrical shape. Rotor 1 possesses a shoulder 20 formed upon the cylindrical shape for positioning and sealing of a lock pin 34. A lock pin spring 34a is coupled to lock pin 34 for engaging lock pin 34 against a counter force exerted by control fluid pressure. Upon shoulder 20, vane 18 is formed. The second vane 16, is formed directly upon the cylindrical shape of rotor 1. As can be seen, vane 16, vane 18, shoulder 20, and the cylindrical shape form an integral part of rotor 1.

On the center of the cylindrical shape of rotor 1, there is a cylindrical hollow disposed to receive sequentially a control valve spring 31*a*, a sleeve 33 with a sleeve plug 31, a control valve 32, and a retainer ring 32*b*. Control valve spring 31*a* is disposed to have a one end thereof engaging sleeve plug 31 and the other end engaging one end of control valve 32. Control valve 32 possesses a number of lands 32*a*. In this case, three lands 32*a* are provided. A retainer ring 32*b* is positioned on a second end of control valve 32. A ball 50 is provided which is disposed to be press fitted into rotor 1. A number of dowel pins are provided for connecting purposes. For example, pin 52 is used for giving radial position for timing and pin 54 is used for radial orientation for spring retention plate 26.

Figure 2:
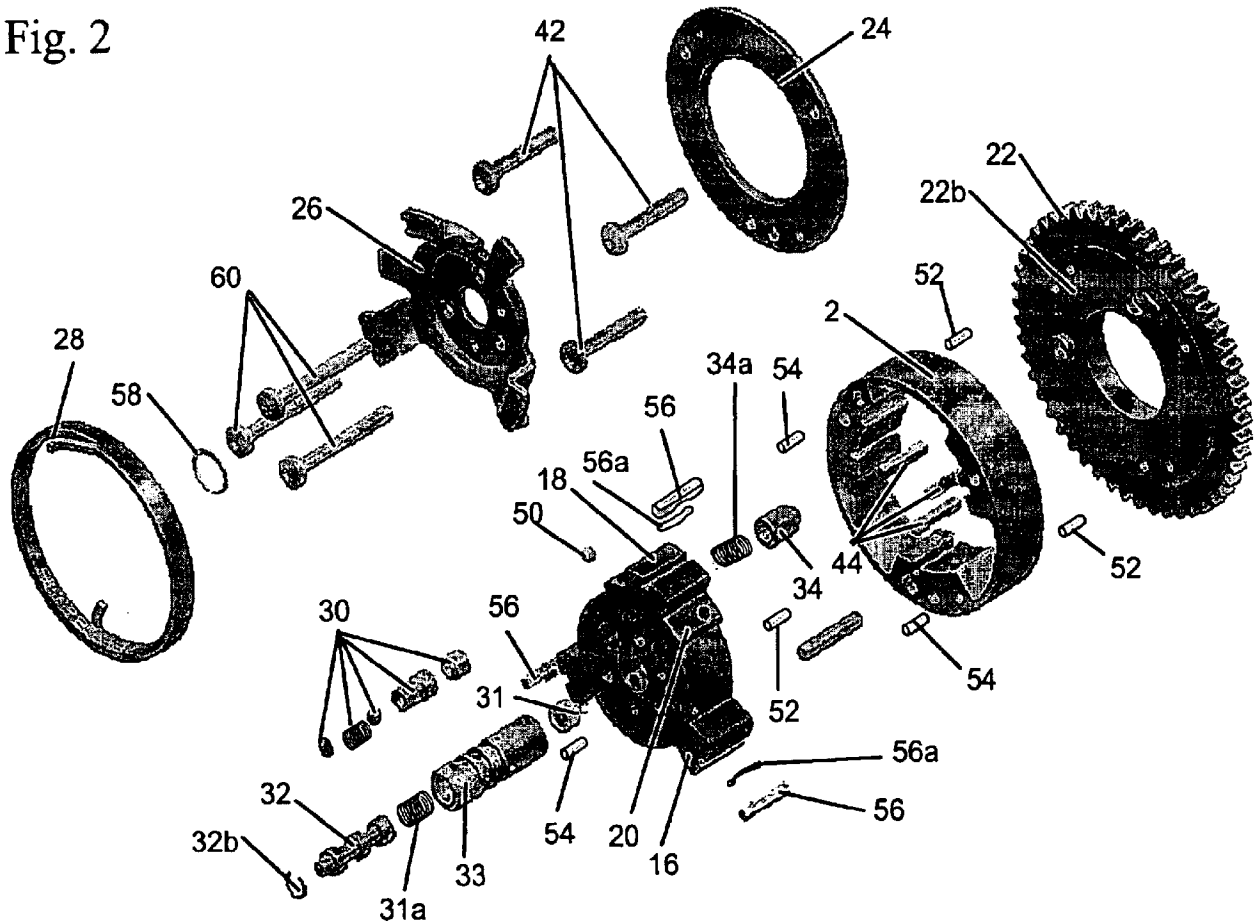
FIG. 2 shows a second exploded view of the present invention.

Referring specifically to FIG. 2, a second exploded view of the present invention is depicted. As can be seen in FIG. 2, all the members of FIG. 1 are shown herein, and additionally some other members are depicted. Specifically, a housing 2 is provided to contain rotor 1 substantially therein. A set of elements is interposed between rotor 1 and housing 2. The elements are vane tip seal 44 positioned over housing 2 with vane tip seal spring (not shown) interposed therebetween, and vane tip seals 56 positioned over rotor 1 with vane tip (seal) spring 56*a* interposed therebetween.

Along the center axis and positioned on top of rotor 1 and housing 2, an outer plate 24 is provided. Outer plate 24 has a set of apertures for a corresponding set of housing bolts 42 which are disposed to pass through the apertures and terminate upon a set of corresponding receiving seats on housing 2. A spring retention plate 26 is provided to be positioned on outer plate 24 at the other side of rotor 1. Spring retention plate 26 has a set of apertures for a corresponding set of cam shaft mounting bolts 60, which are disposed to pass through the apertures and terminate upon a set of corresponding receiving seats on rotor 1. A torsional spring 28 is disposed to be positioned upon spring retention plate 26 which has a set of suitable receiving elements for torsional spring 28. A ring 58 is provided along the center axis as shown.

Figure 3:
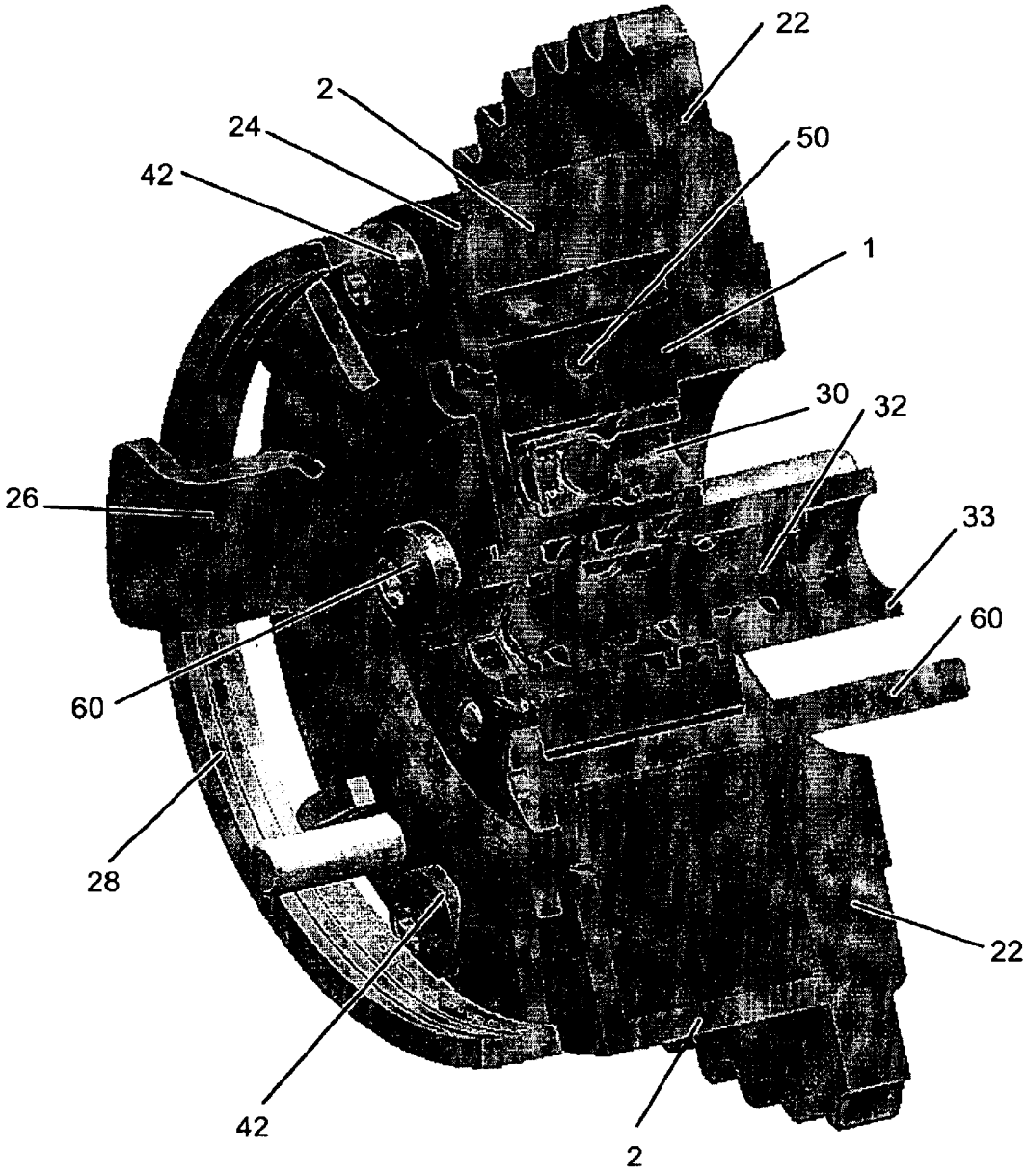
FIG. 3 shows a first sectional perspective view of the present invention.

Referring specifically to FIG. 3, a first sectional perspective view of the present invention is depicted. Substantially all the elements or members are introduced in FIGS. 1 and 2. In the first sectional perspective view, a sectional view of check valve 30 is shown. As can be seen check valve 30 is positioned within the confines of rotor 1 and housing 2. Alternatively, check valve 30 may be positioned anywhere in close proximity to a phaser, for example in the cam shaft end that is in close proximity to the phaser. Additionally, a sectional view of control valve 32 is shown depicting some of the passages for flow of control fluid, the mechanism of which is shown infra. Furthermore, sectional views of other members are shown herein as well. The other members include sprocket 22, housing 2, rotor 1, ball 50, sleeve 33, cam shaft mounting bolts 60, outer plate 24, torsional spring 28, and spring retention plate 26 respectively.

Control fluid coming from a source (not shown in FIG. 3) has to pass through check valve 30 first and is limited by check valve 30 before flowing through the rest of the VCT control passages which are depicted infra.

Figure 4:
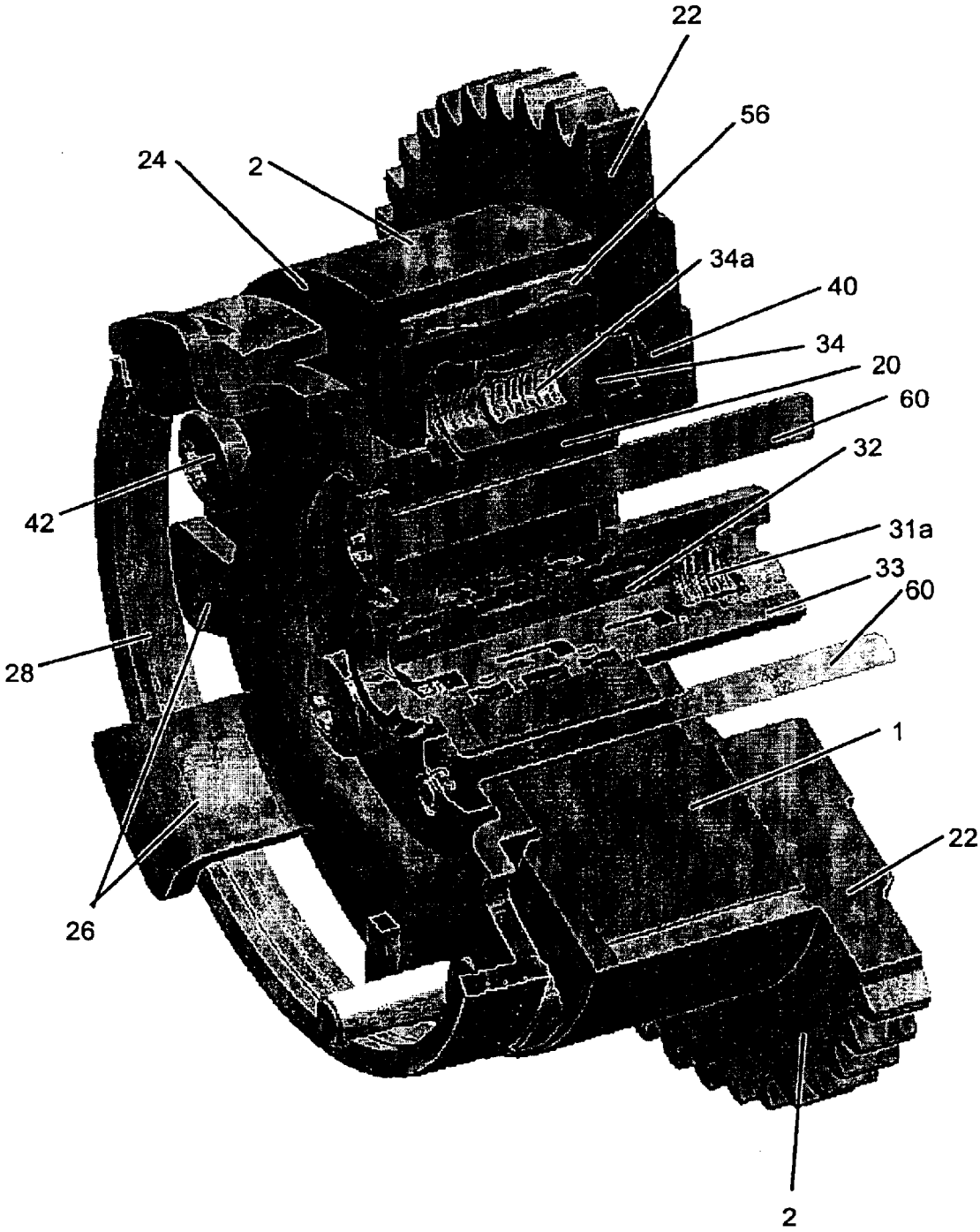
FIG. 4 shows a second sectional perspective view of the present invention.

Referring specifically to FIG. 4, a second sectional perspective view of the present invention is depicted. Substantially all the elements or members are introduced in FIGS. 1 and 2, as well as FIG. 3. In the second sectional perspective view, a sectional view of lock pin 34 and lock pin spring 34*a* are shown. As can be seen, receiving hole 40 formed on sprocket 22 is used to lock the phaser at a fixed angular relationship between two shafts. A sectional view of vane tip seals 56 interposed between vane 18 and a cavity in housing 2 is also shown. Also noted is the shoulder 20 formed by overlaying upon the cylindrical portion of rotor 1. This structure may be due to the compact size of the phaser in that given the form factors of lock pin 34 and rotor 1, it is desirable to have shoulder 20 in order to better retain control fluid enclosed by the relevant members.

Figure 5:
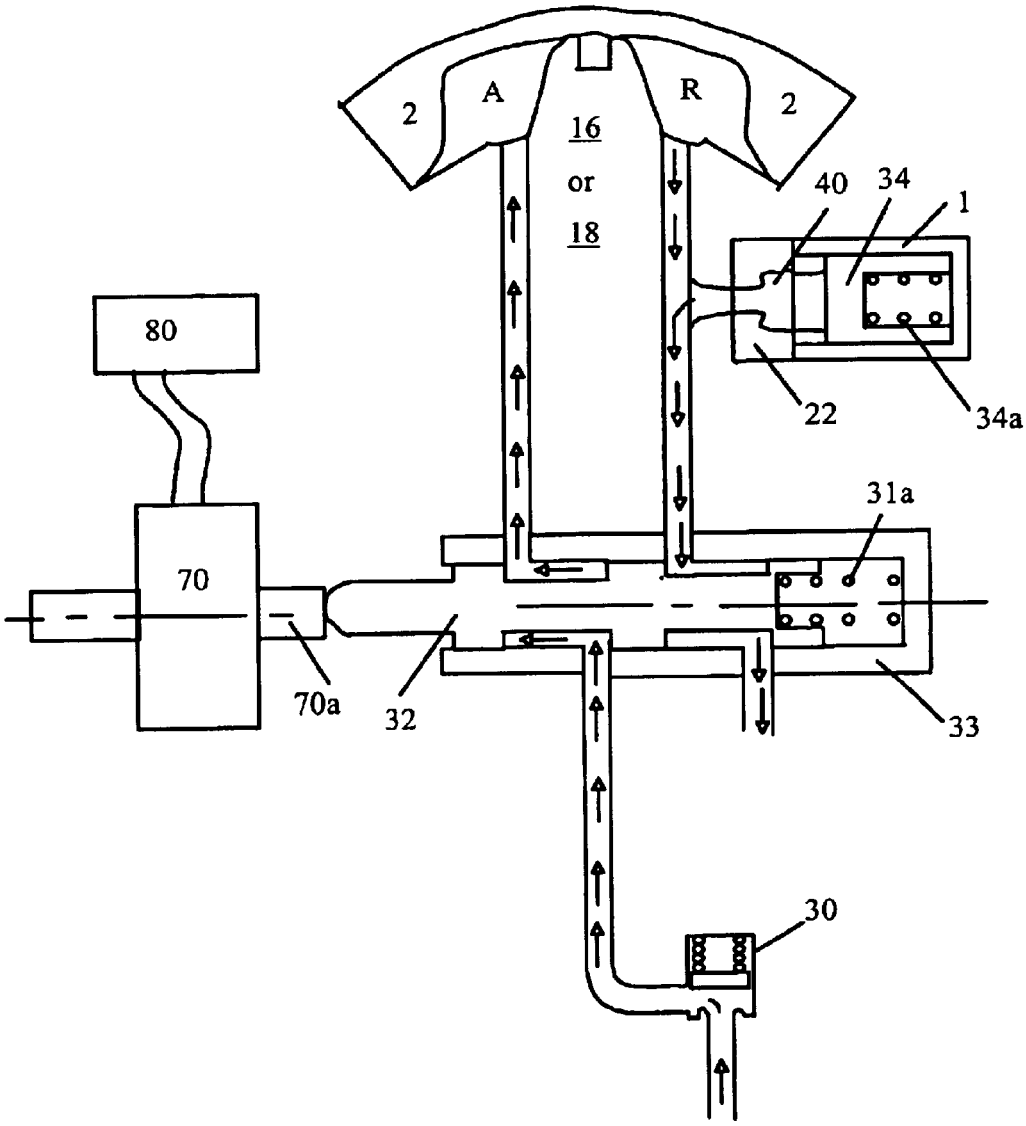
FIG. 5 shows a first diagrammatical view of the present invention.

Referring specifically to FIG. 5, a first diagrammatical view of the present invention is depicted. The first diagrammatical view specifically shows a phase shift to advance position while lock pin 34 is disengaged with receiving hole 40, thereby the phaser maintains the unlocked state. In the phase shift to advance process, control valve 32 is positioned as shown in which control fluid is permitted to flow from retard chamber R to advance chamber A. Thereby vane 16 or vane 18 moves toward chamber R.

If there is insufficient control fluid within the above described circulation, control fluid from a source is permitted to replenish. This is achieved by having fluid from the source, which is in one way fluid communication with the rest of VCT fluid passages as shown in the present figure to flow unidirectionally through check valve 30.

Both retard chamber R and advance chamber A define a cavity within housing 2. The cavity in conjunction with vane 16 or vane 18 defines chamber R and chamber A. The built-in lock pin 34 is encompassed by rotor 1 and engaged by lock pin spring 34*a*. In the present figure, lock pin 34 is disengaged from receiving hole 40 by such means as control liquid pressure. An actuator 70 such as a solenoid, which is controlled by controller 80 is disposed to engage control valve 32 at a first end thereof. On a second or opposite end of control valve 32, control valve spring 31 a engages control valve 32 to balance a force exerted by actuator 70. Control valve 32 is contained substantially within sleeve 33.

If there is an over supply of control fluids, a sink or sump channels the excess control fluid away from the VCT passages. The sink also functions to channel undesirable air contained within the VCT passages away therefrom.

Figure 6:
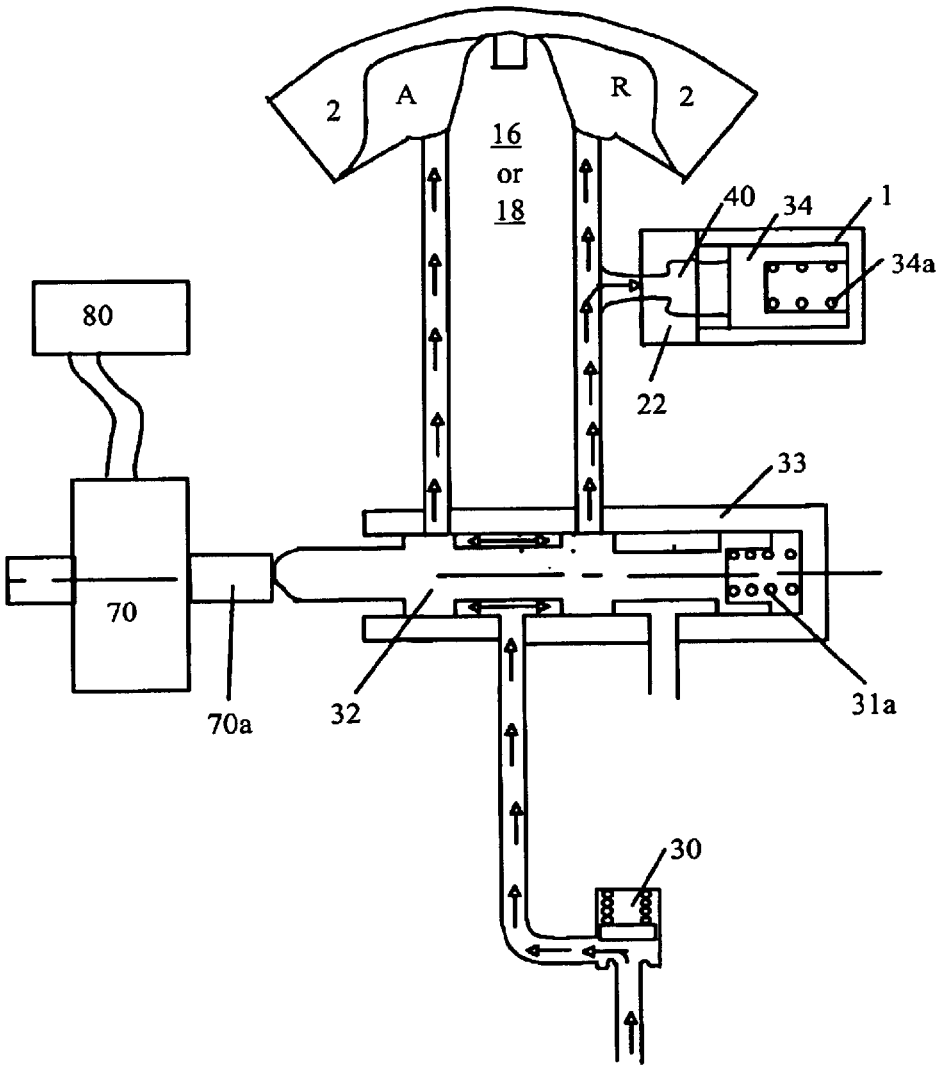
FIG. 6 shows a second diagrammatical view of the present invention.

Referring specifically to FIG. 6, a second diagrammatical view of the present invention is depicted. The second diagrammatical view specifically shows a null position—while lock pin 34 is disengaged with receiving hole 40, thereby the phaser maintains the unlocked state. In the null position, control valve 32 is positioned as shown in which control fluid is neither permitted to flow from retard chamber R to advance chamber A, nor permitted to flow from advance chamber A to retard chamber R. Thereby a fixed angular relationship is maintained by having no substantial relative movement between rotor 1 and housing 2 with rotor 1 being represented by vane 16 or vane 18.

Similar to FIG. 5, if there is insufficient control fluid within the above described circulation, control fluid from a source is permitted to replenish that fluid from the source, which is in one way fluid communication with the rest of VCT fluid passages, as shown in the present figure by means of check valve 30. Both chamber R and chamber A define a cavity within housing 2. The cavity in conjunction with vane 16 or vane 18 defines chamber R and chamber A. The built-in lock pin 34 is encompassed by rotor 1 and engaged by lock pin spring 34*a*. In the present figure, lock pin 34 is disengaged from receiving hole 40 by such means as control liquid pressure. An actuator 70, which is controlled by controller 80 is disposed to engage control valve 32 at a first end thereof. On a second or opposite end of control valve 32, control valve spring 31 a engages control valve 32 to balance a force exerted by actuator 70. Control valve 32 is contained substantially within sleeve 33. If there is an over supply of control fluids, a sink or sump channels the excess control fluid away from the VCT passages. The sink also functions to channel undesirable air contained within the VCT passages away therefrom.

Figure 7:
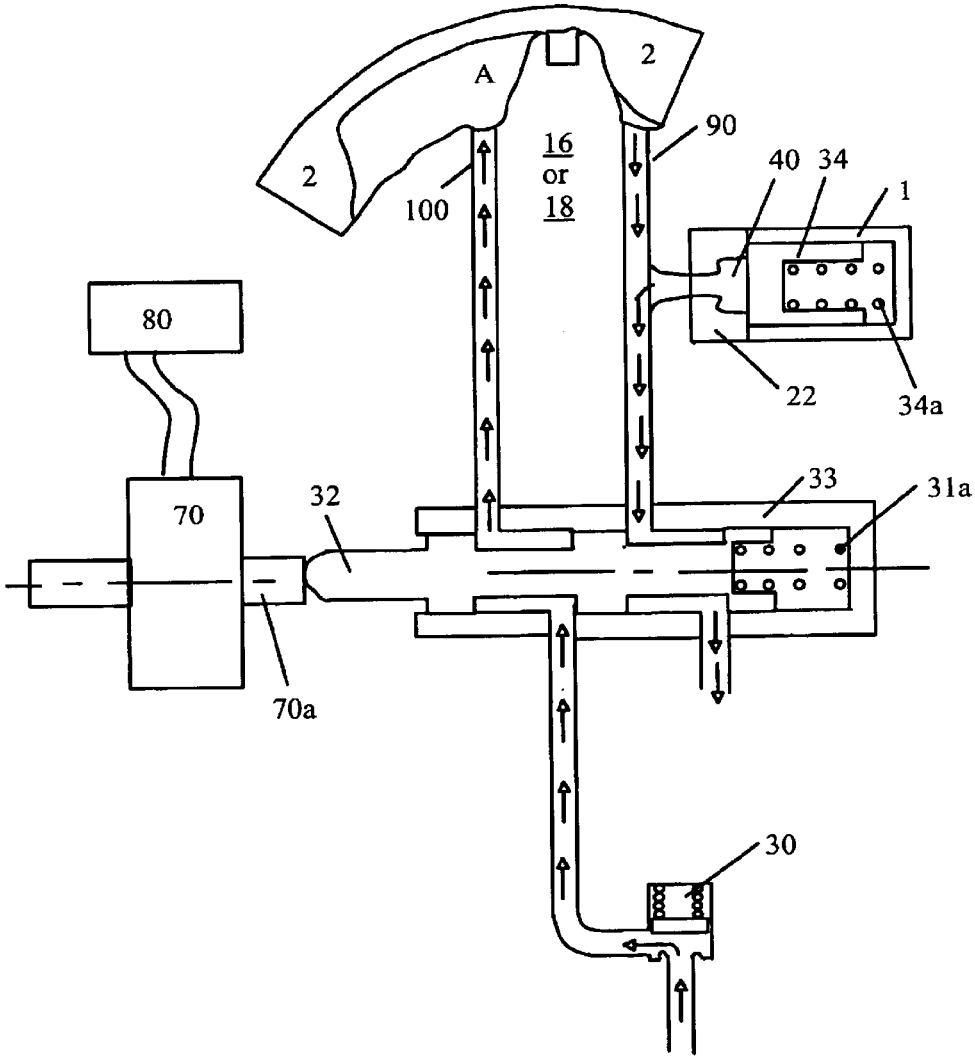
FIG. 7 shows a third diagrammatical view of the present invention.

Referring specifically to FIG. 7, a third diagrammatical view of the present invention is depicted. The third diagrammatical view specifically shows a locked position—at full advance wherein lock pin 34 is engaged with receiving hole 40, thereby the phaser maintains the locked state with vane 16 or vane 18 sat full advance position. In the locked position, lock pin 34 extends into receiving hole 40 thereby no relative movement between rotor 1 and housing 2 occurs.

Figure 8:
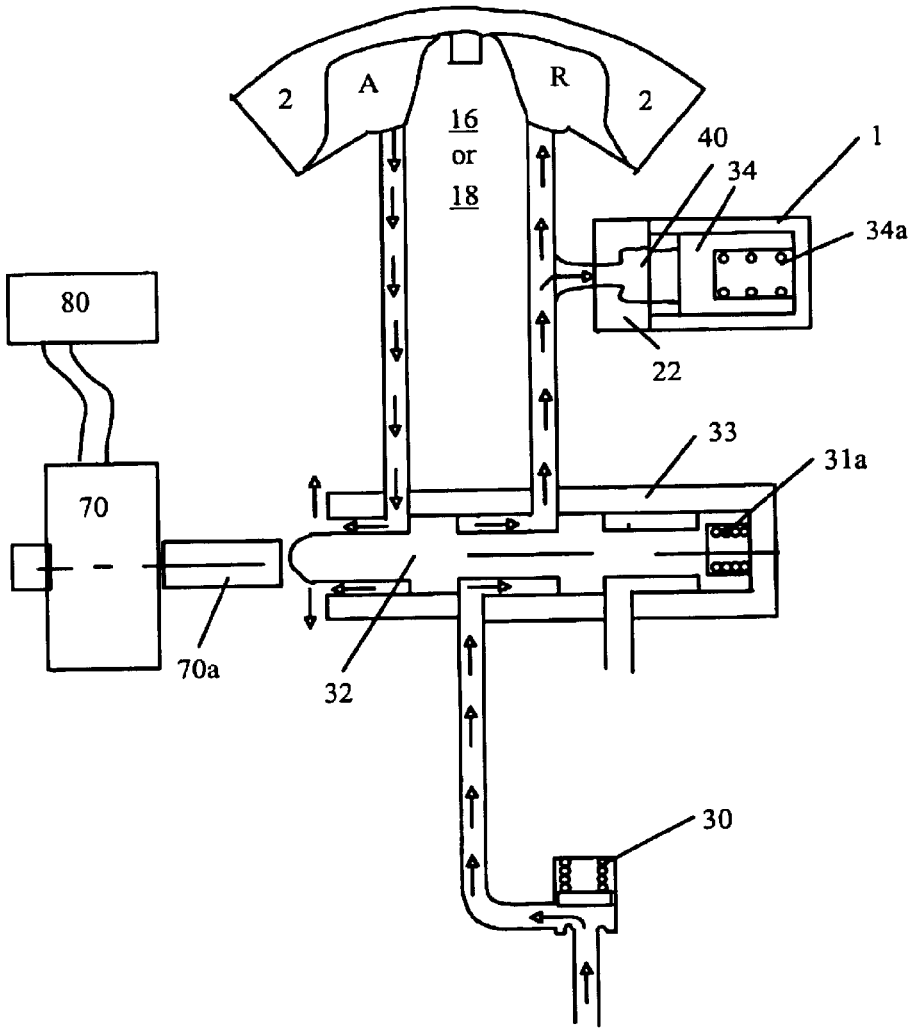
FIG. 8 shows a fourth diagrammatical view of the present invention.

Referring specifically to FIG. 8, a fourth diagrammatical view of the present invention is depicted. The fourth diagrammatical view maybe considered as a reversal of FIG. 5. FIG. 8 specifically shows a phase shift to retard position while lock pin 34 is disengaged with receiving hole 40, thereby the phaser maintains the unlocked state. In the phase shift to retard process, control valve 32 is positioned as shown in which control fluid is permitted to flow from advance chamber A to retard chamber R. Thereby vane 16 or vane 18 allows fluid movements toward chamber A. Also similar to FIG. 5, if there is insufficient control fluid within the above described circulation, control fluid from a source is permitted to replenish that fluid from the source, which is in one way fluid communication with the rest of VCT fluid passages as shown in the present figure by means of check valve 30. Both chamber R and chamber A define a cavity within housing 2. The cavity in conjunction with vane 16 or vane 18 defines chamber R and chamber A. The built-in lock pin 34 is encompassed by rotor 1 and engaged by lock pin spring 34*a*. In the present figure, lock pin 34 is disengaged from receiving hole 40 by such means as control liquid pressure. An actuator 70, which is controlled by controller 80 is disposed to engage control valve 32 at a first end thereof. On a second or opposite end of control valve 32, control valve spring 31a engages control valve 32 to balance a force exerted by actuator 70. Control valve 32 is contained substantially within sleeve 33. If there is an over supply of control fluids, a sink or sump channels the excess control fluid away from the VCT passages. The sink also functions to channel undesirable air contained within the VCT passages away therefrom.

As can be appreciated, the present invention includes components that constitute a phaser such as a sprocket 22, rotor 1, housing 2, endplate 24, spring retention plate 26 and a bias spring 28. The phaser is designed to mount to a camshaft (not shown) so that the camshaft can be phased relative to a driving shaft such as a crankshaft (also not shown). The rotor 1 is mounted to the camshaft with three fasteners 60 which go through the spring retention plate 26 to fasten the rotor to the cam. The rotor 1 pilots to the camshaft on (one) counter bore on the backside of the rotor 1. The counter bore may be a 2 millimeter deep counter bore on the backside of the rotor l. The endplate 24 and housing 2 are bolted to the cam sprocket 22 which moves relative to the rotor 1 assembly. This relative motion is caused by cam torsional energy or oil pressure. The phaser bearing surface is the inside diameter 22*b* of the sprocket 22.

The present invention further teaches a novel rotor 1 assembly which includes several structural features. The first feature is the inlet check valve 30 built within the structure of the phaser or in close proximity to the phaser for reducing control fluid leakage. A torsional assist phaser has an inlet check valve 30 to eliminate back drive of the phaser which is caused by torque reversals. The check valve 30 closes when chamber pressure goes high thereby preventing control fluid such as oil to flow backwards. This check valve 30 also helps improve response time, decreases oscillation, and decreases oil consumption. Furthermore, check valve 30 also allows the phaser to move during cranking when there are sufficient cam torsionals and very little oil pressure. In addition, inlet check valve 30 is suitably located within the phaser structure or in very close proximity to the phaser such as within the cam shaft structure at the phaser end. Thereby, the control fluid leakage is reduced.

The present invention further provides a centered mounted spool 32. Spool 32 is center mounted in the rotor 1, thereby reducing the number of leak paths between the control system and the phaser as on other non-center mounted valves. With a center mounted spool 32 all control ports and control oil leakage is internal to the phaser. This allows for a simpler camshaft structure. In the present embodiment only one passage is needed in the camshafts as compared to a conventional oil pressure device which requires two oil passages in the camshaft. A center mounted spool 32 design also has the flexibility of using an electro-mechanical actuator or an electro-hydraulic actuator.

An active locking pin 34 built within the phaser is provided. Active locking pin 34 is required so that the phaser does not unlock during an undesirable condition such as engine start up or cranking. The lock 34 is pressurized when the spool 32 is commanded to move away from its default position. In this embodiment, the default phaser position is full advance as shown in FIG. 7. However, other positions such as full retard may be designated as the default phaser position in lieu of full advance. When spool 32 is "out," the advance chamber A is pressurized and the retard chamber R and lock pin 34 are vented to the crank case, which moves the phaser to full advance. The lock pin spring 34*a* pushes the lock pin 34 into a receiving hole 40 of the cam sprocket 22 which locks the phaser at full advance. A locking pin 34 is needed to lock the phaser in the correct position during start up. It is also required to have an active lock so that the phaser does not unlock during extreme temperature conditions when the device or the phaser may be difficult to control by using the spool valve 32.

In addition, within the rotor 1, cushioned stops are provided. This feature restricts the oil flow out of the chamber that is being exhausted. This restriction occurs only when the phaser is operating close to or at the physical stops of the device. The trapped oil acts as a hydraulic damper which reduces the impact forces of the rotor 1 hitting the cavity wall of housing 2. The cushioning is achieved by formning passages opening 90 and 100 of rotor 1 on both shoulders of vane 18 or vane 16, and forming the cavity of housing 2 in such a way as shown in FIG. 7.

The present invention provides a special vane shape. The special shape is a pair of shoulders 20 of the rotor 1 forming the lock pin chamber. Only one vane 18 has the special shape if there exists only one locking pin. The shoulder 20 is interposed between vane 18 and the body of rotor 1. This shape (with the shoulders 20) reduces lock pin 34 leakage when the phaser is away from the locked position. This vane geometry including the shoulders 20 ensures that the rotor 1 face is always covering the locking pin hole 40 regardless of the vane position.

Furthermore, a center mounted spool 32 valve is provided. The typical 4-way valve has four lands. To help reduce package and other form factor related issues, the spool 32 valve of the present invention is reduced to three lands 32*a*. The two outer lands are the lands used in the control of this device. The center annulus is where supply oil enters the device. The spool/sleeve 33 are designed such that the inlet underlap is always greater than or equal toe the exhaust overlap. This feature guarantees that the chamber being filled does not create a vacuum, which would cause air to be sucked into the device.

Torsion spring 28 mounted on the front of the phaser is provided. The torsion spring 28 is required to ensure that the phaser can reach base timing under all conditions. Since base timing is at full advance the phaser uses a bias spring 28 to overcome the cam bearing friction and the oil pump loads which tend to force the phaser opposite of base timing. These mean torque inputs typically force the phaser towards the retard stop.

The following are terms and concepts relating to the present invention.

It is noted that the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system, in which the VCT system uses torque reversals in the camshaft caused by the forces of opening and closing engine valves to move the vane. The control valve in a CTA system allows fluid flow from advance chamber to retard chamber, allowing the vane to move, or stops flow, locking the vane in position. The CTA phaser may also have oil input to make up for losses due to leakage but does not use engine oil pressure to move the phaser. The vane is a radial element, upon which actuating fluid acts, housed in the chamber. A vane phaser is a phaser which is actuated by vanes moving in chambers.

There may be one or more camshafts per engine. The camshaft may be driven by a belt, chain, gears, or another camshaft. Lobes may exist on the camshaft to push the valves. A multiple camshaft engine, most often has one shaft for exhaust valves and one shaft for intake valves. A "V" type engine usually has either two camshafts (one for each bank) or four (intake and exhaust for each bank) camshafts.

A chamber is defined as a space within which a vane rotates. A chamber may be divided into an advance chamber, which makes valves open sooner relative to the crankshaft, and a retard chamber, which makes valves open later relative to the crankshaft. A check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). A control valve is a valve which controls flow of fluid to the phaser. The control valve may exist within the phaser in a CTA system. The control valve may be actuated by oil pressure or a solenoid. The crankshaft takes power from the pistons and drives the transmission and camshaft. A spool valve is defined as a control valve of spool type. Typically the spool rides in a bore, connecting one passage to another. Most often the spool is located on the center axis of a rotor of a phaser.

A Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure). Full supply pressure is supplied to the other end of the spool (hence differential pressure). A Valve Control Unit (VCU) is a control circuitry for controlling the VCT system. Typically the VCU acts in response to commands from the ECU.

A driven shaft is any shaft which receives power (in a VCT, most often a camshaft). A driving shaft is any shaft which supplies power (in a VCT, most often a crankshaft, but possibly a camshaft driving another camshaft). ECU is the Engine Control Unit that is the car's computer. Engine Oil is the oil used to lubricate the engine. Oil pressure can be tapped to actuate the phaser through a control valve.

The housing is defined as the outer part of the phaser with chambers. The outside of the housing can be a pulley (for timing belt), sprocket (for timing chain), or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". A lock pin is disposed to lock a phaser in position. Usually a lock pin is used when oil pressure is too low to hold the phaser, as during engine start or shutdown.

An Oil Pressure Actuated (OPA) VCT system uses a conventional phaser, where engine oil pressure is applied to one side of the vane or the other to move the vane.

An open loop is used in a control system which changes one characteristic in response to another (e.g., moves a valve in response to a command from the ECU) without feedback to confirm the action.

The phase is defined as the relative angular position of the camshaft and crankshaft (or camshaft and another camshaft, if the phaser is driven by another cam). A phaser is defined as the entire part which mounts to the cam. The phaser is typically made up of a rotor and housing and possibly a spool valve and check valves. A piston phaser is a phaser actuated by pistons in cylinders of an internal combustion engine. A rotor is the inner part of the phaser, which is attached to a cam-shaft.

Pulse-width Modulation (PWM) provides a varying force or pressure by changing the timing of on/off pulses of current or fluid pressure. A solenoid is an electrical actuator which uses electrical current flowing in a coil to move a mechanical arm. A variable force solenoid (VFS) is a solenoid whose actuating force can be varied, usually by PWM of the supply current. A VFS differs from an on/off (all or nothing) solenoid.

A sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

A Torsion Assist (TA)—or Torque Assisted phaser is a variation on the OPA phaser, which adds a check valve in the oil supply line (i.e. a single check valve embodiment) or a check valve in the supply line to each chamber (i.e. a two check valve embodiment). The check valve blocks oil pressure pulses due to torque reversals from propagating back into the oil system and stops the vane from moving backward due to torque reversals. In the TA system, motion of the vane due to forward torque effects is permitted; hence the expression "torsion assist" is used. The graph of vane movement is a step function.

A VCT system includes a phaser, control valve(s), control valve actuator(s), and control circuitry. Variable Cam Timing (VCT) is a process, not a thing, that refers to controlling and/or varying the angular relationship (phase) between one or more camshafts, which drive the engine's intake and/or exhaust valves. The angular relationship also includes the phase relationship between the cam and the crankshafts, in which the crank-shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. References herein to details of the illustrated embodiments are not intended to limit the scope of the claims, which themselves recite those features regarded as essential to the invention.

What is claimed is:

1. A phaser for maintaining an angular relationship between a crank-shaft and a cam-shaft or among more than one cam-shaft, comprising:

a housing, having at least one locking pin hole and at least one cavity defined by an arcuate outer wall, a first side wall, and a second side wall;

a rotor, disposed to move relative to the housing, the rotor including:

a hub;

a plurality of vanes integral to the rotor and protruding from the hub, the plurality of vanes being disposed to oscillate within their respective chambers formed by the rotor and the housing, thereby maintaining the angular relationship; and a shoulder integral to the rotor extending from the hub into the chamber, wherein the shoulder oscillates with the vane, thereby ensuring that the rotor face is always covering the locking pin hole, such that the locking pin hole is not exposed to the control fluid pressure of the respective chamber of the vane, regardless of vane position; the first side wall and second side wall of the cavity being formed with recesses to accommodate the shoulder; and a locking pin located in the vane and positioned to engage the locking pin hole in the housing.

2. The phaser of claim 1 further comprising an inlet check valve located within the phaser structure or in very close proximity to the phaser, thereby reducing control fluid leakage.

3. The phaser of claim 2, wherein the inlet check valve is located within the cam-shaft, thereby reducing control fluid leakage.

4. The phaser of claim 1 further comprising a center mounted spool disposed along a center line perpendicular to the rotor.

5. The phaser of claim 4, wherein the center mounted spool includes three lands.

6. The phaser of claim 1 further comprising a torsion spring for compensating the cam bearing friction or the oil pump loads which tend to force the phaser opposite of base timing.

7. A phaser for maintaining an angular relationship between a crank-shaft and a cam-shaft or among more than one cam-shaft, comprising:

a housing, having at least one cavity defined by an arcuate outer wall, a first side wall, and a second side wall;

a rotor, disposed to move relative to the housing, the rotor including:

a hub, and a plurality of vanes integral to the rotor and protruding from the hub, the plurality of vanes being disposed to oscillate within their respective chambers formed by the rotor and the housing, thereby maintaining the angular relationship; and an inlet check valve located within the camshaft, thereby reducing control fluid leakage.

8. The phaser of claim 7 further comprising:

a shoulder integral to the rotor and extending from the hub into the chamber, wherein the shoulder oscillates with the vane, thereby ensuring that the rotor face is always covering a locking pin hole in the housing, such that the locking pin hole is not exposed to the control fluid pressure of the respective chamber of the vane, regardless of vane position; the first side wall and second side wall of the cavity being formed with recesses to accommodate the shoulder; and a locking pin located in the vane and positioned to engage the locking pin hole in the housing.

9. The phaser of claim 7 further comprising a center mounted spool disposed along a center line perpendicular to the rotor.

10. The phaser of claim 9, wherein the center mounted spool includes three lands.

11. The phaser of claim 7 further comprising a torsion spring for compensating the cam bearing friction or the oil pump loads which tend to force the phaser opposite of base timing.

* * * * *